US008878744B2

(12) United States Patent
Nilsson

(10) Patent No.: US 8,878,744 B2
(45) Date of Patent: Nov. 4, 2014

(54) ANTENNA ASSEMBLY PROVIDING A GLOBAL MULTI-DIRECTIONAL RADIATION PATTERN

(75) Inventor: Jack Nilsson, Medina, OH (US)

(73) Assignee: MP Antenna, Ltd., North Ridgeville, OH (US)

( * ) Notice: Subject to any disclaimer, the term of this patent is extended or adjusted under 35 U.S.C. 154(b) by 166 days.

(21) Appl. No.: 13/235,859

(22) Filed: Sep. 19, 2011

(65) Prior Publication Data

US 2012/0068910 A1 Mar. 22, 2012

Related U.S. Application Data

(60) Provisional application No. 61/384,340, filed on Sep. 20, 2010.

(51) Int. Cl.
*H01Q 21/29* (2006.01)
*H01Q 21/24* (2006.01)

(52) U.S. Cl.
CPC ..... *H01Q 21/29* (2013.01); *H01Q 21/24* (2013.01)
USPC ..... 343/893; 343/825

(58) Field of Classification Search
USPC ..... 343/893, 825, 826, 827, 829, 830, 793
See application file for complete search history.

(56) References Cited

U.S. PATENT DOCUMENTS

| | | | | |
|---|---|---|---|---|
| 3,715,759 | A | 2/1973 | Esposito et al. | |
| 4,091,327 | A | 5/1978 | Larsen et al. | |
| 4,185,289 | A | 1/1980 | DeSantis et al. | |
| 5,859,615 | A | 1/1999 | Toland et al. | |
| 6,801,170 | B2 | 10/2004 | Forrester et al. | |
| 2003/0076262 | A1 | 4/2003 | Forrester et al. | |
| 2003/0122719 | A1* | 7/2003 | Nilsson et al. | 343/711 |
| 2004/0027300 | A1 | 2/2004 | Kim et al. | |
| 2004/0164917 | A1* | 8/2004 | Nilsson | 343/773 |
| 2004/0164918 | A1* | 8/2004 | Nilsson | 343/773 |
| 2005/0115056 | A1 | 6/2005 | Leisten et al. | |
| 2005/0146471 | A1 | 7/2005 | Kwon et al. | |
| 2006/0022891 | A1 | 2/2006 | O'Neill, Jr. et al. | |
| 2007/0254587 | A1 | 11/2007 | Schadler et al. | |
| 2008/0036686 | A1 | 2/2008 | Barone | |
| 2009/0295668 | A1* | 12/2009 | Nilsson | 343/840 |
| 2010/0045562 | A1 | 2/2010 | Drake et al. | |
| 2010/0053010 | A1 | 3/2010 | Shtrom et al. | |

* cited by examiner

*Primary Examiner* — Hoanganh Le

(74) *Attorney, Agent, or Firm* — Tarolli, Sundheim, Covell & Tummino LLP

(57) ABSTRACT

An antenna assembly having a characteristic frequency band includes an antenna feed, operatively connected to one of a radio frequency (RF) transmitter, an RF receiver, and an RF transceiver system, and a ground component. A first set of conductive elements, including either or both of linear, bent linear, and curvilinear elements, is operatively connected to the antenna feed. A second set of conductive elements, including either or both of linear, bent linear, and curvilinear elements, is operatively connected to the ground component. Each of the first set of linear conductive elements and the second set of linear conductive elements are configured as to provide substantially equal sensitivity within the characteristic frequency band across all elevation and azimuth angles.

19 Claims, 4 Drawing Sheets

ANTENNA ASSEMBLY PROVIDING A GLOBAL MULTI-DIRECTIONAL RADIATION PATTERN

RELATED APPLICATION

This application claims priority from U.S. Provisional Patent Application Ser. No. 61/384,340, filed Sep. 20, 2010, the subject matter of which is incorporated herein by reference.

TECHNICAL FIELD

Certain embodiments of the present invention relate to antennas for wireless communications. More particularly, certain embodiments of the present invention relate to an apparatus and method providing an antenna assembly providing substantially isotropic sensitivity within an associated frequency band for use in point-to-point and point-to-multipoint communication applications for the Internet, land, maritime, aviation, and space.

BACKGROUND OF THE INVENTION

Wireless communications have always struggled with limitations of audio, video, and data transport and internet connectivity in both obstructed and line-of-sight (LOS) deployments. A focus on antenna gain and transceiver processing solutions has proven to have significant limitations. While lower frequency radio waves benefit from low elevation propagation and higher frequencies do inherently benefit from reflection and penetration characteristics, due to topographical changes (hills & valleys) and obstructions, both natural and man-made, and the accompanying reflections, diffractions, refractions and scattering, the maximum signal received may well be off-axis, that is, received via a path that is not line-of-sight. Further, destructive interference of multipath signals can result in nulls and locations of diminished signal. Some antennas may benefit from having gain at one elevation angle to 'capture' signals of some pathways, while other antennas have greater gain at another elevation angle, each type being insufficient where the other does well. Radio waves can also experience altered polarizations as they propagate, reflect, refract, diffract, and scatter. A preferred polarization path may exist, but insufficient capture of the signal can result if this preferred path is not utilized.

BRIEF SUMMARY OF THE INVENTION

In accordance with an aspect of the invention, an antenna assembly having a characteristic frequency band includes an antenna feed, operatively connected to one of a radio frequency (RF) transmitter, an RF receiver, and an RF transceiver system, and a ground component. A first set of conductive elements, including one or more of linear, bent linear, and curvilinear elements, is operatively connected to the antenna feed. A second set of conductive elements, including one or more of linear, bent linear, and curvilinear elements, is operatively connected to the ground component. Each of the first set of conductive elements and the second set of conductive elements are configured as to provide substantially equal sensitivity within the characteristic frequency band across all elevation and azimuth angles.

In accordance with another aspect of the present invention, an antenna assembly includes a first active element connected to an antenna feed at an apex point and extending in a first direction, and a first counterpoise element connected to a ground element associated with the antenna feed and extending in a second direction substantially perpendicular to the first direction. A second active element is connected to the antenna feed at the apex point and extends in a third direction substantially perpendicular to the first direction. A second counterpoise element is connected to the ground element and extends in a fourth direction substantially perpendicular to the third direction.

In accordance with yet another aspect of the present invention, an antenna assembly is configured to provide a substantially isotropic response at a characteristic wavelength of the antenna assembly. A first active element is operatively connected to an antenna feed and oriented along a first axis. The first active element is one of linear, bent linear, or curvilinear and has a length substantially equal to one-half of the characteristic wavelength. A first counterpoise element is operatively connected to the antenna feed and oriented along the first axis to provide. The first counterpoise element is one of linear or curvilinear and has a length substantially equal to one-half of the characteristic wavelength.

A second active element is operatively connected to an antenna feed and oriented along a second axis that is perpendicular to the first axis. The second active element is one of linear or curvilinear and has a length substantially equal to one-half of the characteristic wavelength. A second counterpoise element is operatively connected to the antenna feed and oriented along the second. The second counterpoise element is one of linear or curvilinear and has a length substantially equal to one-half of the characteristic wavelength.

BRIEF DESCRIPTION OF THE DRAWINGS

The foregoing and other features of the present invention will become apparent to those skilled in the art to which the present invention relates upon reading the following description with reference to the accompanying drawings, in which.

DETAILED DESCRIPTION OF THE INVENTION

Figure 1:
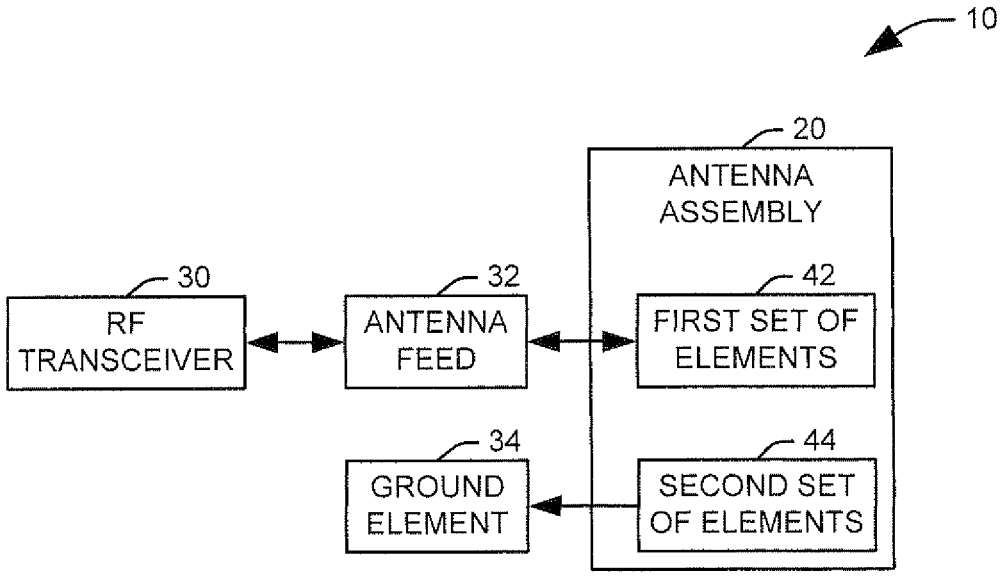
FIG. 1 illustrates a communications system comprising an antenna module configured to provide a substantially isotropic response in accordance with an aspect of the present invention.

FIG. 1 illustrates a radio frequency (RF) communications system 10 in accordance with an aspect of the present invention, comprising an antenna module 20 configured to provide a globally multi-directional response, that is, a substantially isotropic response. It will be appreciated that the term "radio frequency," is intended to encompass frequencies within the microwave and traditional radio bands, specifically frequencies between 3 kHz and 3 THz. By a "substantially isotropic response," it is meant that a radiation pattern of the antenna would have substantially unity gain along all elevation and azimuth angles. While the antenna assembly 20 can be configured to provide some wideband performance, it will be appreciated that the antenna assembly 10 is tuned to a characteristic frequency, $\eta$, representing a frequency band to which the antenna is maximally receptive. Accordingly, the antenna assembly also has a characteristic wavelength, $\lambda$, equal to $c/\eta$, where c represents the speed of light in a vacuum, equal to approximately 300,000,000 m/s.

The communications system 10 can comprise an RF transceiver module 30 configured to transmit signals through the antenna module 20 and receive process the radio frequency signals from the antenna module to recover information from the radio frequency signals. To this end, the RF transceiver module 30 is electrically coupled to the antenna module 20 through an antenna feed 32, such that signals received at the antenna module can be processed at the transceiver module. It will be appreciated that, in place of the transceiver module 30, the communications system 10 can include a dedicated RE transmitter or RF receiver electrically coupled to the antenna. The antenna feed 32 can be paired an associated ground element 34, and it will be appreciated that the antenna feed 32 and the ground element 34 can be provided at the antenna as an integral antenna feed, such as an SMA connector.

The antenna module 20 comprises a plurality of elements which can be either linear, curvilinear, or bent linear. By "bent linear," it is meant that the element is generally linear, but defines at least one acute or obtuse angle along its length, such that a first segment of the element is aligned in a first direction and a second segment is aligned in a second direction. It will further be appreciated that, as used herein, a "substantially linear" element can include small bends necessary for practical implementation of the antenna. For example, a given active element can be bent slightly to avoid contact with the ground element 34 before extending linearly from the antenna feed 32. A first set of these elements 42 are connected to the antenna feed 32 at a common apex point and a second set of the plurality of elements are connected to the ground element. As stated previously, the antenna module 20 is configured to provide a substantial orthogonal response, with a substantially equal gain along all elevation and azimuth angles. By "substantially equal", it is meant that the variation of the antenna from the isotropic pattern is less than five decibels in along any point in the spherical pattern. In accordance with an aspect of the present invention, the isotropic behavior can be created by configuring the first set of elements 42 and the second set of elements 44 as to provide a substantially circularly polarized response within three mutually orthogonal planes. It will be appreciated that by a "substantially circularly polarized response," it is meant that the polarization loss factor of the antenna for a circularly polarized signal of the appropriate handedness is trivial (e.g., considerably less than the at least twenty decibel polarization loss factor expected for a linearly polarized antenna receiving such a signal.). By maintaining a common handedness of the circular polarization along the three axes, the off-axis antenna response is defined by constructively adding signals from the various axes, allowing for a substantially even gain at all elevation and azimuth angles.

It will be appreciated that an antenna providing an isotropic pattern provides only unity gain, such that the gain of the illustrated antenna module is less than that of a simple dipole antenna. In accordance with an aspect of the present invention, however, it has been determined that the ability of the antenna assembly to be responsive to multiple polarizations and multiple directions can significantly improve the performance of the antenna, extending its useful range. For example, polarization diversity at the receive end increases the likelihood of capturing usable signal after the signal properties have been altered by obstructed pathways. Polarization diversity at the transmit end increases likelihood of a useable obstructed environment pathway (e.g., through nooks and crannies) to the receiver. It will thus be appreciated that a communications system in accordance with the present invention can provide a significant improvement in performance for some applications although it provides a somewhat lower gain signal. This can be especially useful in applications having a limited range of coverage, but a significant number of obstructions. For example, an antenna in accordance with an aspect of the present invention can be utilized in a wireless router.

Figure 2:
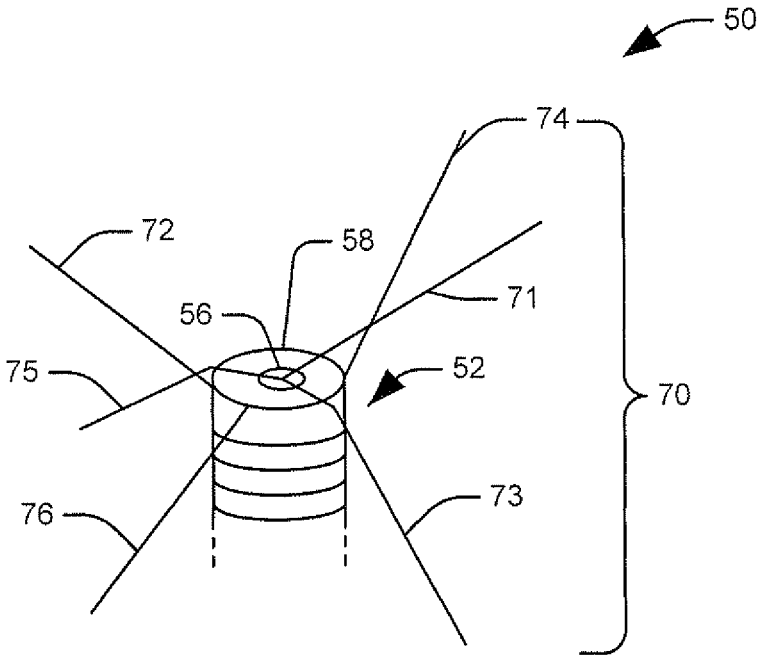
FIG. 2 illustrates a first exemplary implementation of an antenna module in accordance with an aspect of the present invention.

FIG. 2 illustrates a first exemplary implementation of an antenna module 50 in accordance with an aspect of the present invention. The antenna module 50 comprises an antenna feed 52 configured to connect a transceiver module to an antenna assembly 70. In the illustrated implementation, the antenna feed 52 can be of various types, such as a coaxial connector, a twin lead connector, or another suitable connector for use with an antenna. In the illustrated implementation, the antenna feed 52 can comprise an SMA coaxial connector, comprising a center conductor 56 and a ground shield 58 A dielectric material can be used to electrically insulate the center conductor 56 from the ground shield 58. It will be appreciated that while the antenna module 50 is illustrated with a coaxial feed, any of a variety of feed techniques can be used.

In accordance with an aspect of the present invention, the antenna assembly 70 comprises a plurality of linear elements 71-76 configured to provide an isotropic response. Each of the plurality of linear elements has a length approximately equal to one-quarter of a characteristic wavelength of the antenna module 50. For ease of explanation, the orientation and placement of the linear elements is described in relation to an arbitrary coordinate system, with a first coordinate axis defined to be parallel to the antenna feed connector 52. A first active element 71 is connected at a first end to the center conductor 56 and extends at an acute angle relative each of to the first coordinate axis and a first plane, defined to be normal to the first coordinate axis and include the first end of the first active element, on a first side of the first plane. In the illustrated implementation, the first active element 71 forms a thirty degree angle with the first plane.

A first counterpoise element 72 is connected at a first end to the ground shield 58 and extends on the first side of the first plane at an acute angle. In the illustrated implementation, the first counterpoise element 72 forms a thirty degree angle with the first plane. In accordance with an aspect of the present invention, the first counterpoise element 72 is configured to be substantially perpendicular to the first active element 71, such that a straight line distance across a first gap defined by the respective second ends of the first active element and the first counterpoise element is approximately seven-twentieths of the characteristic wavelength of the antenna assembly 50. In accordance with an aspect of the present invention, the first active element 71 and the first counterpoise element 72 are configured such that the first gap is aligned to be perpendicular to the first axis. A second axis of the arbitrary coordinate system can be defined to be parallel to the first gap and pass through an end of center conductor 56, such that the end of center conductor defines an origin of the arbitrary coordinate system. A third coordinate axis can be defined to be perpendicular to each of the first and second axes and pass through the defined origin.

A second active element 73 is connected at a first end to the center conductor 56 and extends on the first side of the first plane at an acute angle relative to the first plane. Defining a second plane as a plane normal to the second coordinate axis that includes the origin, the second active element 73 extends on a first side of the second plane and the second side of the first plane at an acute angle with each plane. In the illustrated implementation, the second active element 73 forms a forty-five degree angle with the first plane and a thirty degree angle with the second plane. A second counterpoise element 74 is connected at a first end to the ground shield 58 and extends on the first side of the second plane and the first side of the first plane, forming an acute angle with each of the second plane and the first plane. In the illustrated implementation, the second counterpoise element 74 forms a forty-five degree angle with the first plane and a thirty degree angle with the second plane. The second counterpoise element 74 is configured to be substantially perpendicular to the second active element 73, such that a straight line distance across a second gap defined by the respective second ends of the second active element and the second counterpoise element is approximately seven-twentieths of the characteristic wavelength of the antenna assembly 50. In accordance with an aspect of the present invention, the second active element 73 and the second counterpoise element 74 are configured such that the second gap is substantially parallel to the first coordinate axis, and thus substantially perpendicular to the first gap.

A third active element 75 is connected at a first end to the center conductor 56 and extends on the second side of the first plane at an acute angle relative to the first plane. Defining a third plane as a plane normal to the third coordinate axis that includes the origin, the third active element 75 extends on a first side of the third plane and the second side of the first plane at an acute angle with each plane. In the illustrated implementation, the third active element 75 forms a forty-five degree angle with the third plane and a thirty degree angle with the first plane. A third counterpoise element 76 is connected at a first end to the ground shield 58 and extends on the second side of the third plane at an acute angle and the second side of the first plane with each of the third plane and the first plane. In the illustrated implementation, the third counterpoise element 76 forms a forty-five degree angle with the third plane and a thirty degree angle with the first plane. The third counterpoise element 76 is configured to be substantially perpendicular to the third active element 75, such that a straight line distance across a third gap defined by the respective second ends of the third active element and the third counterpoise element is approximately seven-twentieths of the characteristic wavelength of the antenna assembly 50. Specifically, the third active element 75 and the third counterpoise element 76 are configured such that the third gap is substantially parallel to the third coordinate axis, and thus perpendicular to each of the first and second gaps.

In accordance with an aspect of the present invention, the antenna assembly is configured to provide a substantially isotropic response in a frequency band around the characteristic frequency of the antenna. Specifically, the first active element 71 and the first counterpoise element 72 are configured to provide a first bent half-wave dipole, substantially aligned with the second axis, with the first gap positioned one-eighth of the characteristic wavelength from the first plane on the first side of the first plane, and one-eighth of a wavelength from the third plane on the first side of the third plane. Similarly, the second active element 73 and the second counterpoise element 74 are configured to provide a second bent half-wave dipole, substantially aligned with the first axis, with the second gap positioned one-eighth of the characteristic wavelength from the second plane on the first side of the second plane, and one-eighth of a wavelength from the third plane on the second side of the third plane. The third active element 75 and the third counterpoise element 76 are configured to provide a third bent half-wave dipole, substantially aligned with the third axis, with the third gap positioned one-eighth of the characteristic wavelength from the second plane on a second side of the second plane, and one-eighth of a wavelength from the first plane on the second side of the first plane.

It will be appreciated that the active elements are in phase, being commonly fed and of standard length, and the antenna assembly is thus configured to provide a substantially circularly polarized response along each of the first, second, and third axes. In accordance with an aspect of the present invention, the isotropic behavior of the antenna assembly 50 can be provided by arranging the plurality of linear elements 71-76 to maintain a common handedness of the circular polarization along each axis. This allows the signals along each axis to be mutually reinforcing at their points of intersection, providing an even response at angles intermediate to the various axes.

Figure 3:
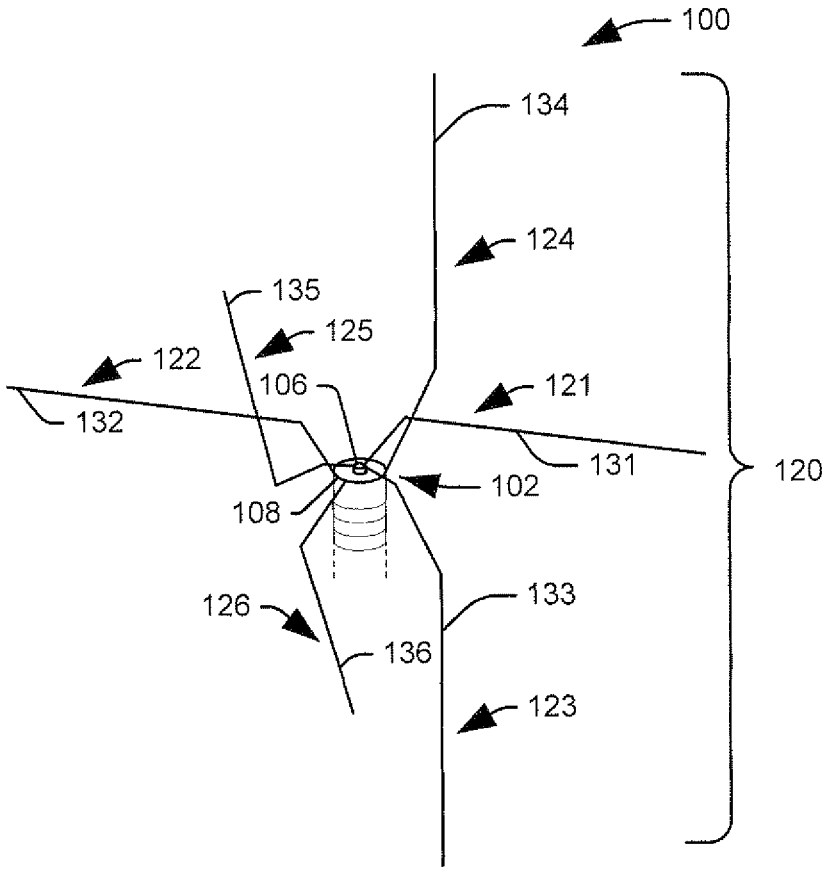
FIG. 3 illustrates a second exemplary implementation of an antenna module in accordance with an aspect of the present invention.

FIG. 3 illustrates a second exemplary implementation of an antenna module 100 in accordance with an aspect of the present invention. The antenna module 100 comprises an antenna feed connector 102 configured to connect a transceiver module to an antenna assembly 120. In the illustrated implementation, the antenna feed connector 102 can include a coaxial connector, such as an SMA connector, comprising a center conductor 106 and a ground shield 108. A dielectric material can be used to electrically insulate the center conductor 106 from the ground shield 108. It will be appreciated that while the antenna module 100 is illustrated with a coaxial feed, any of a variety of feed techniques can be used.

In accordance with an aspect of the present invention, the antenna assembly 120 comprises a plurality of elements 121-126 configured to provide an isotropic response. Each of the plurality of elements has a length approximately equal to three-quarters of a characteristic wavelength of the antenna module 100, and is bent linear, with a bend in at one point to form an obtuse angle. In the illustrated implementation, the bend forms a one hundred thirty-five degree angle and occurs at a point one quarter of the characteristic wavelength from the connection point. Accordingly, each of the plurality of elements, while continuous, can be conceptualized as a first linear segment, having a length of approximately one-quarter of the characteristic wavelength and connected to the antenna feed connector, and a second linear segment, having a length approximately equal to one-half of the characteristic wavelength. For ease of explanation, the orientation and placement of the bent linear elements is described in relation to an arbitrary coordinate system, with a first coordinate axis defined to be parallel to the antenna feed connector 102.

A first active element 121 is connected at a first end to the center conductor 106. The first active element 121 initially extends at an acute angle relative each of to the first coordinate axis and a first plane, defined to be normal to the first coordinate axis and include the first end of the first active element, on a first side of the first plane. In the illustrated implementation, the first active element 121 forms, at the point of connection, a thirty degree angle with the first plane and a forty-five degree angle with the first coordinate axis. The bend in the first active element results in a first half-wave segment 131 in a first direction oriented perpendicularly to the first coordinate axis.

A first counterpoise element 122 is connected at a first end to the ground shield 108, and initially extends on the first side of the first plane at an acute angle relative to each of the first coordinate axis and the first plane. In the illustrated implementation, the first counterpoise element 122 forms, at the point of connection, a thirty degree angle with the first plane and a forty-five degree angle with the first coordinate axis. In accordance with an aspect of the present invention, the first counterpoise element 122 is configured to initially extend from the ground shield at an angle substantially perpendicular to an initial the first active element 121, such that a first segment of first counterpoise element 122 is substantially perpendicular to the first segment of the first active element. The bend in the second counterpoise element 122 results in a second half-wave segment 132 oriented to be substantially collinear with the first half-wave segment 131, but extending in a second direction opposite to the first direction. Accordingly, a straight line distance between the first half-wave segment 131 and the second half-wave segment 132 is approximately seven-twentieths of the characteristic wavelength of the antenna assembly 100. A second axis of the arbitrary coordinate system can be defined to be parallel to the first half-wave segment 131 and the second half-wave segment 132 and pass through an end of center conductor 106, such that the end of center conductor defines an origin of the arbitrary coordinate system. A third coordinate axis can be defined to be perpendicular to each of the first and second axes and pass through the defined origin.

A second active element 123 is connected at a first end to the center conductor 106. Defining a second plane as a plane normal to the second coordinate axis that includes the origin, the second active element 123 initially on a first side of the second plane and the second side of the first plane at an acute angle with each plane. In the illustrated implementation, the second active element 123 forms, at the point of connection, a forty-five degree angle with the first plane and a thirty degree angle with the second plane. The bend in the second active element results in a third half-wave segment 133 oriented in a third direction parallel to the first coordinate axis.

A second counterpoise element 124 is connected at a first end to the ground shield 108, and initially extends on the first side of the second plane and the first side of the first plane to form acute angle with each of the second plane and the first plane. In the illustrated implementation, the second counterpoise element 124 forms, at the point of connection, a forty-five degree angle with the first plane and a thirty degree angle with the second plane. The bend in the second counterpoise element 124 results in a fourth half-wave segment 134 oriented to be substantially collinear with the third half-wave segment 133, but extending in a fourth direction opposite to the third direction. Accordingly, a straight line distance between the third half-wave segment 133 and the fourth half-wave segment 134 is approximately seven-twentieths of the characteristic wavelength of the antenna assembly 100.

A third active element 125 is connected at a first end to the center conductor 106. Defining a third plane as a plane normal to the third coordinate axis that includes the origin, the third active element 125 initially extends on a first side of the third plane and the second side of the first plane at an acute angle with each plane. In the illustrated implementation, the third active element 125 forms, at the point of connection, a forty-five degree angle with the third plane and a thirty degree angle with the first plane. The bend in the third active element results in a fifth half-wave segment 135 oriented in a fifth direction perpendicular to each of the first and second coordinate axes.

A third counterpoise element 126 is connected at a first end to the ground shield 108, and initially extends on the second side of the third plane at an acute angle and the second side of the first plane with each of the third plane and the first plane. In the illustrated implementation, the third counterpoise element 126 forms a forty-five degree angle with the third plane and a thirty degree angle with the first plane. The bend in the third counterpoise element 126 results in a sixth half-wave segment 136 oriented to be substantially collinear with the fifth half-wave segment 135, but extending in a sixth direction opposite to the third direction. Accordingly, a straight line distance between the fifth half-wave segment 135 and the sixth half-wave segment 136 is approximately seven-twentieths of the characteristic wavelength of the antenna assembly 100.

In accordance with an aspect of the present invention, the antenna assembly 100 is configured to provide a substantially isotropic response in a frequency band around the characteristic frequency of the antenna. Specifically, the first half-wave dipole 131 and the second half-wave dipole 132 are aligned as to be substantially parallel to the second axis and are positioned on opposite sides of the second plane. Each of the first and second half-wave dipoles 131 and 132 is positioned to be one-eighth of the characteristic wavelength from each of the first plane and the third plane. Similarly, the third half-wave dipole 133 and the fourth half-wave dipole 134 are aligned as to be substantially parallel to the first axis and are positioned on opposite sides of the first plane. Each of the third and fourth half-wave dipoles 133 and 134 is positioned to be one-eighth of the characteristic wavelength from each of the second plane and the third plane, and such that a distance, taken along the third axis, between the line defined by the first and second half-wave dipoles 131 and 132 and the line defined by the third and fourth half-wave dipoles 133 and 134 is substantially equal to one-quarter of the characteristic wavelength. The fifth half-wave dipole 135 and the sixth half-wave dipole 136 are aligned as to be substantially parallel to the third axis and are positioned on opposite sides of the third plane. Each of the fifth and sixth half-wave dipoles 135 and 136 is positioned to be one-eighth of the characteristic wavelength from each of the second plane and the third plane, and such that each of a first distance, taken along the first axis between the line defined by the first and second half-wave dipoles 131 and 132 and the line defined by the fifth and sixth half-wave dipoles 135 and 136, and a second distance, taken along the second axis between the line defined by the third and fourth half-wave dipoles 133 and 134 and the line defined by the fifth and sixth half-wave dipoles 135 and 136, is substantially equal to one-quarter of the characteristic wavelength.

It will be appreciated that the sensitivity of each half-wave dipole 131-136 decreases with the angle of elevation, but the dipoles are arranged to be orthogonal and configured such that the signals provide circular polarization of the same handedness. In accordance with an aspect of the present invention, it has been determined that these signals effectively reinforce one another due to being of same handed circular polarization as to provide continuous sensitivity at all azimuth and elevation angles by addition rather than subtraction of fields. Accordingly, the active elements of illustrated antenna module 120 can be fed at a common feed in a standard manner to provide an isotropic response.

Figure 4:
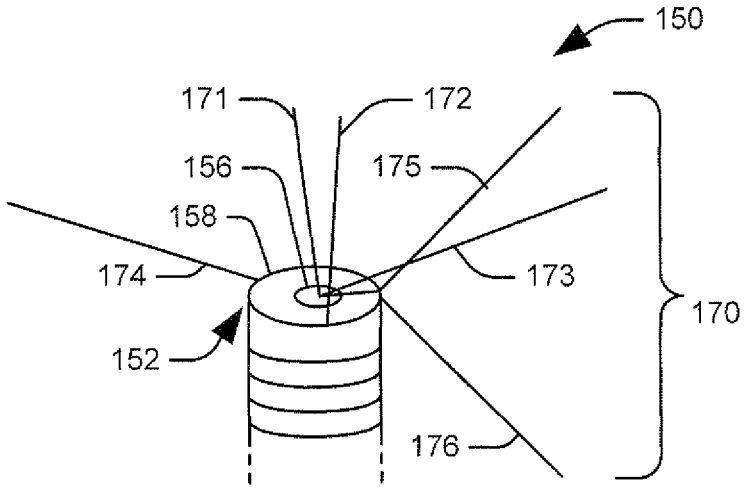
FIG. 4 illustrates a third exemplary implementation of an antenna module in accordance with an aspect of the present invention.

FIG. 4 illustrates a third exemplary implementation of an antenna module 150 in accordance with an aspect of the present invention. The antenna module 150 comprises an antenna feed 152 configured to connect a transceiver module to an antenna assembly 170. In the illustrated implementation, the antenna feed 152 can be of various types, such as a coaxial connector, a twin lead connector, or another suitable connector for use with an antenna. In the illustrated implementation, the antenna feed 152 can comprise an SMA coaxial connector, comprising a center conductor 156 and a ground shield 158. A dielectric material can be used to electrically insulate the center conductor 156 from the ground shield 158. It will be appreciated that while the antenna module 150 is illustrated with a coaxial feed, any of a variety of feed techniques can be used.

In accordance with an aspect of the present invention, the antenna assembly 170 comprises a plurality of linear elements 171-176 configured to provide an isotropic response. Each of the plurality of linear elements has a length approximately equal to one-quarter of a characteristic wavelength of the antenna module 150. For ease of explanation, the orientation and placement of the linear elements is described in relation to an arbitrary coordinate system, with an origin at the point of connection of the linear elements 171-176 to the antenna feed connector 152 and a first coordinate axis defined to be parallel to the antenna feed connector, such that, in FIG. 4, the first coordinate axis is substantially vertical within the plane of the page.

A first active element 171 is connected at a first end to the center conductor 156 and extends at an acute angle relative each of to the first coordinate axis and a first plane, defined to be normal to the first coordinate axis and include the first end of the first active element, on a first side of the first plane. A first counterpoise element 172 is connected at a first end to the ground shield 158 and extends on the first side of the first plane at an acute angle as to be substantially perpendicular to the first linear element 171. The first active element 171 and the first counterpoise element 172, taken together, define a second plane that is perpendicular to the first plane. In FIG. 4, ignoring a slight rotation applied for perspective, would run vertically within the page and perpendicularly to the plane of the page, that is, normal to an axis running horizontally within the page. In the illustrated implementation, the active element 171 and the first counterpoise element 172 each form approximately a forty-five degree angle with the first axis. A second axis of the arbitrary coordinate system can be defined to be normal to the second plane and pass through the defined origin of the arbitrary coordinate system, such that, in FIG. 4, ignoring a slight rotation applied for perspective, the second coordinate axis runs horizontally within the plane of the page. A third coordinate axis can be defined to be perpendicular to each of the first and second axes and pass through the defined origin, as to run substantially perpendicularly to the plane of the page. A third plane can be defined as a plane normal to the third axis, that is, the plane of the page.

A second active element 173 is connected at a first end to the center conductor 156 and extends from the second connector within the first plane on a first side of the second plane. A second counterpoise element 174 is connected at a first end to the ground shield 158 and extends from the ground shield within the first plane on a second side of the second plane. The second counterpoise element 174 is configured to be substantially perpendicular to the second active element 173. In the illustrated implementation, each of the second active element 173 and the second counterpoise element 174 forms a forty-five degree angle with the third coordinate axis. A third active element 175 is connected at a first end to the center conductor 156 and extends within the third plane on a first side of the first plane. A third counterpoise element 176 is connected at a first end to the ground shield 158 and extends within third plane on a second side of the second plane as to be substantially perpendicular to the third active element. In the illustrated implementation, each of the third active element 175 and the third counterpoise element 176 forms a forty-five degree angle with the second coordinate axis.

In accordance with an aspect of the present invention, the antenna assembly is configured to provide a substantially isotropic response in a frequency band around the characteristic frequency of the antenna, Specifically, the first active element 171 and the first counterpoise element 172 are configured to provide a first bent half-wave dipole, configured to be aligned along the third coordinate axis. Similarly, the second active element 173 and the second counterpoise element 174 are configured to provide a second bent half-wave dipole, substantially aligned with the second coordinate axis. The third active element 175 and the third counterpoise element 176 are configured to provide a third bent half-wave dipole, substantially aligned with the first coordinate axis. It will be appreciated that the active elements are in phase, being commonly fed and of standard length, and the antenna assembly can thus be configured to provide a substantially circularly polarized response along each of the first, second, and third axes. In accordance with an aspect of the present invention, the isotropic behavior of the antenna assembly 150 can be provided by arranging the plurality of linear elements 171-176 to maintain a common handedness of the circular polarization along each axis. This allows the signals along each axis to be mutually reinforcing at their points of intersection, providing an even response at angles intermediate to the various axes.

Figure 5:
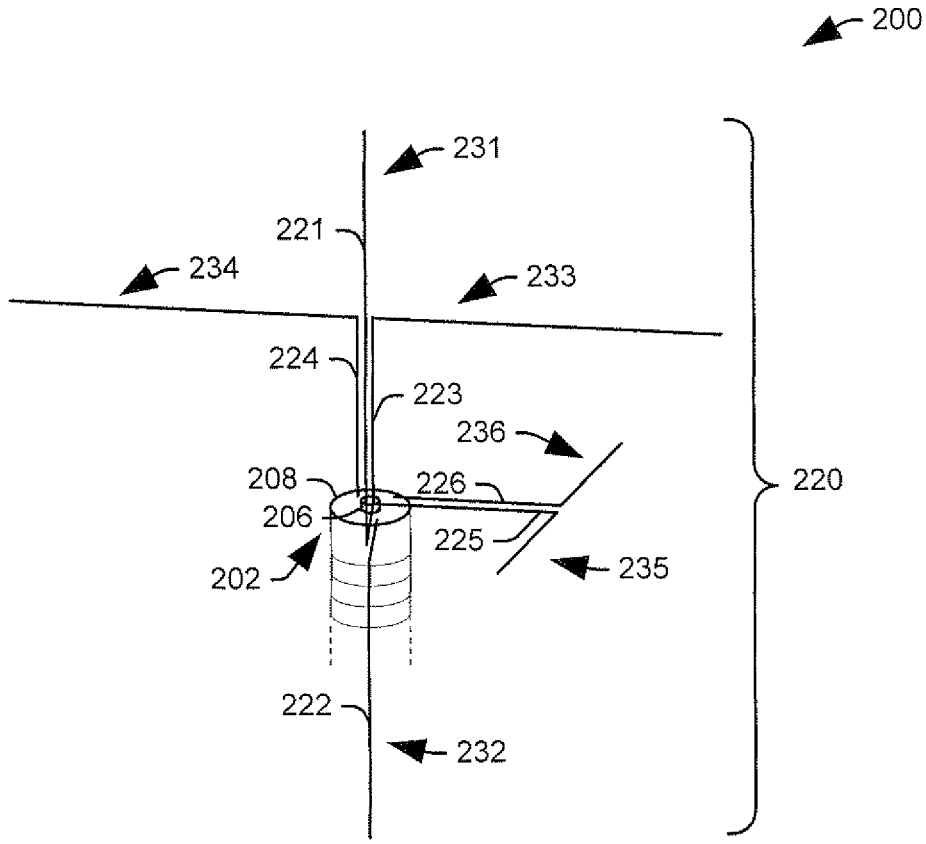
FIG. 5 illustrates a fourth exemplary implementation of an antenna module in accordance with an aspect of the present invention.

FIG. 5 illustrates a fourth exemplary implementation of an antenna module 200 in accordance with an aspect of the present invention. The antenna module 200 comprises an antenna feed connector 202 configured to connect a transceiver module to an antenna assembly 220. In the illustrated implementation, the antenna feed connector 202 can include, at a first end, a coaxial connector, such as an SMA connector, comprising a center conductor 206 and a ground shield 208. A dielectric material can be used to electrically insulate the center conductor 206 from the ground shield 208. It will be appreciated that while the antenna module 200 is illustrated with a coaxial feed, any of a variety of feed techniques can be used.

In accordance with an aspect of the present invention, the antenna assembly 220 comprises a plurality of elements 221-226 configured to provide an isotropic response. Each of the plurality of elements has a length approximately equal to three-quarters of a characteristic wavelength of the antenna module 200, and is bent linear, with at least one bend along their length. In the illustrated implementation, the angle of the bend is substantially equal to ninety degrees and occurs at a point one quarter of the characteristic wavelength from the connection point. Accordingly, each of the plurality of elements, while continuous, can be conceptualized as a first linear segment, having a length of approximately one-quarter of the characteristic wavelength and connected to the antenna feed connector, and a second linear segment, having a length approximately equal to one-half of the characteristic wavelength.

For ease of explanation, the orientation and placement of the bent linear elements is described in relation to an arbitrary coordinate system, with a first coordinate axis defined to be parallel to the antenna feed connector 202, and thus vertical of the page of FIG. 5, and a first plane defined as a plane normal to the first coordinate axis and passing through a first end of the antenna feed connector. A second coordinate axis is defined as an axis perpendicular to the first coordinate axis and running within the first plane. A second axis of the arbitrary coordinate system can be defined to be perpendicular to the first coordinate axis and run within the first plane, such that, in FIG. 5, ignoring a slight rotation applied for perspective, the second coordinate axis runs horizontally within the plane of the page. A third coordinate axis can be defined to be perpendicular to each of the first and second axes and run within the first plane, as to extend substantially perpendicularly to the plane of the page.

A first active element 221 is connected at a first end to the center conductor 206. The first active element 221 initially extends in a direction substantially aligned with the third coordinate axis. The ninety degree bend in the first active element results in a first half-wave segment 231 in a first direction oriented parallel to the first coordinate axis, and running in a direction away from the antenna feed connector 202. A first counterpoise element 222 is connected at a first end to the ground shield 208, and initially extends in a direction in substantially the same direction as the first active element 221 as to be substantially parallel to the second coordinate axis. It will be appreciated that by "substantially," a small amount of deviation from the first plane is intended, such that the first active element 221 and the first counterpoise element 222 can form a small acute angle, bisected by the first plane, sufficient to avoid contact between the first active element and the first counterpoise element. The bend in the first counterpoise element 222 results in a second half-wave segment 232 oriented to be substantially parallel with the first coordinate axis and extend in a direction collinear with but substantially opposite to that of the first half-wave segment 231.

A second active element 223 is connected at a first end to the center conductor 206. The second active element 223 initially extends in a direction substantially aligned with the first coordinate axis. The ninety degree bend in the second active element 223 results in a third half-wave segment 233 in a first direction oriented parallel to the second coordinate axis. The first direction is selected such that, if the initial direction of the first active element 221 is defined as a positive direction of an y-axis and the direction associated with the first half-wave segment 231 is defined as a positive direction of a z-axis, the first direction associated with the third half-wave segment 233, would represent the positive direction of the x-axis. A second counterpoise element 224 is connected at a first end to the ground shield 208, and initially extends in a direction in substantially the same direction as the second active element 223 as to be substantially parallel to the first coordinate axis. As described previously, it will be appreciated that by "substantially," a small amount of deviation from the first plane is intended, such that the second active element 223 and the second counterpoise element 224 can form a small acute angle that is sufficient to avoid contact between the second active element and the second counterpoise element. The bend in the second counterpoise element 224 results in a fourth half-wave segment 234 oriented to be substantially parallel with the second coordinate axis and extend in a direction collinear with but substantially opposite to that of the third half-wave segment 233.

A third active element 225 is connected at a first end to the center conductor 206. The third active element 225 initially extends in a direction substantially aligned with the second coordinate axis. The ninety degree bend in the third active element 225 results in a fifth half-wave segment 235 in a first direction oriented parallel to the third coordinate axis and in the same direction as the initial direction as the first active element 231. A third counterpoise element 226 is connected at a first end to the ground shield 208, and initially extends in a direction in substantially the same direction as the third active element 225 as to be substantially parallel to the second coordinate axis. As described previously, it will be appreciated that by "substantially," a small amount of deviation from the first plane is intended, such that the third active element 225 and the third counterpoise element 226 can form a small acute angle that is sufficient to avoid contact between the third active element and the third counterpoise element. The bend in the third counterpoise element 226 results in a sixth half-wave segment 236 oriented to be substantially parallel with the third coordinate axis and extend in a direction collinear with but substantially opposite to that of the fifth half-wave segment 235.

In accordance with an aspect of the present invention, the antenna assembly 200 is configured to provide a substantially isotropic response in a frequency band around the characteristic frequency of the antenna. Specifically, the first half-wave dipole 231 and the second half-wave dipole 232 are aligned as to be substantially parallel to the first axis, forming a full wave dipole at a point a quarter of the characteristic wavelength along the third coordinate axis from the first end of the antenna feed connector 202. Similarly, the third half-wave dipole 233 and the fourth half-wave dipole 234 are aligned as to be substantially parallel to the second axis, forming a full wave dipole at a point a quarter of the characteristic wavelength along the first coordinate axis from the first end of the antenna feed connector. The fifth half-wave dipole 235 and the sixth half-wave dipole 236 are aligned as to be substantially parallel to the third axis, forming a full wave dipole at a point a quarter of the characteristic wavelength along the second coordinate axis from the first end of the antenna feed connector. Accordingly, the third half-wave dipole 233, the fourth half-wave dipole 234, the fifth half-wave dipole 235 and the sixth half-wave dipole 236, taken collectively, are configured to provide a circularly polarized response along the first coordinate axis. Similarly, the first half-wave dipole 231, the second half-wave dipole 232, the fifth half-wave dipole 235 and the sixth half-wave dipole 236 are configured to provide a circularly polarized response along the second coordinate axis, and the first half-wave dipole 231, the second half-wave dipole 232, the third half-wave dipole 233 and the fourth half-wave dipole 234 are configured to provide a circularly polarized response along the third coordinate axis.

It will be appreciated that the sensitivity of each half-wave dipole 231-236 decreases with the angle of elevation, but the dipoles are arranged to be orthogonal and configured such that the signals provide circular polarization of the same handedness. In accordance with an aspect of the present invention, it has been determined that these signals effectively reinforce one another due to being of same handed circular polarization as to provide continuous sensitivity at all azimuth and elevation angles by addition rather than subtraction of fields. Accordingly, the active elements of illustrated antenna module 220 can be fed at a common feed in a standard manner to provide an isotropic response.

Figure 6A:
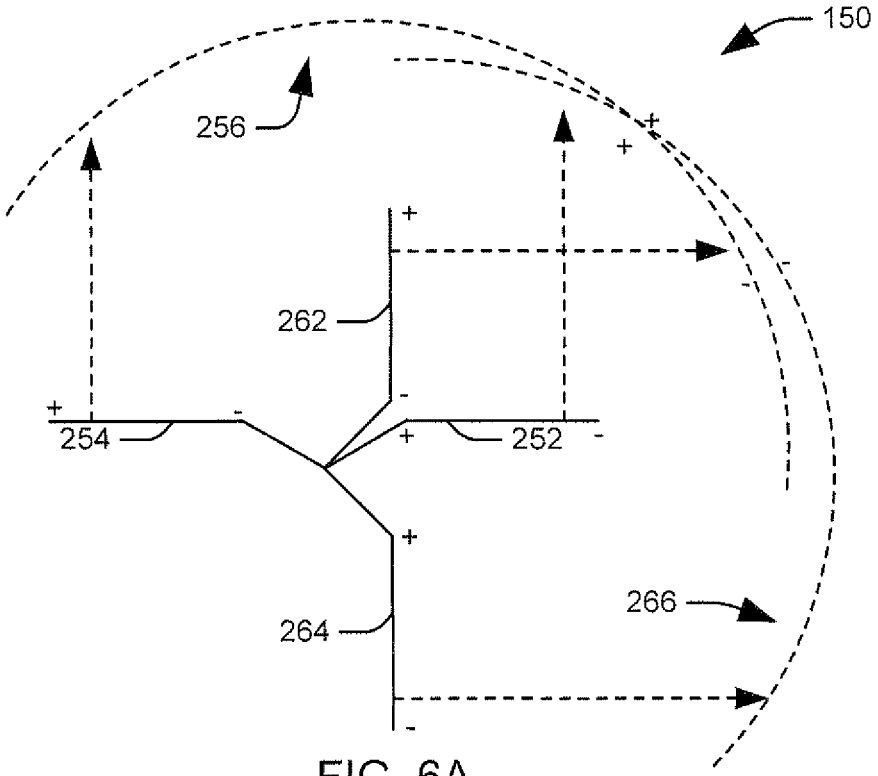
FIG. 6A illustrates a cross sectional view of an antenna system at a first time illustrating the constructive interference of the generated signals in space.
Figure 6B:
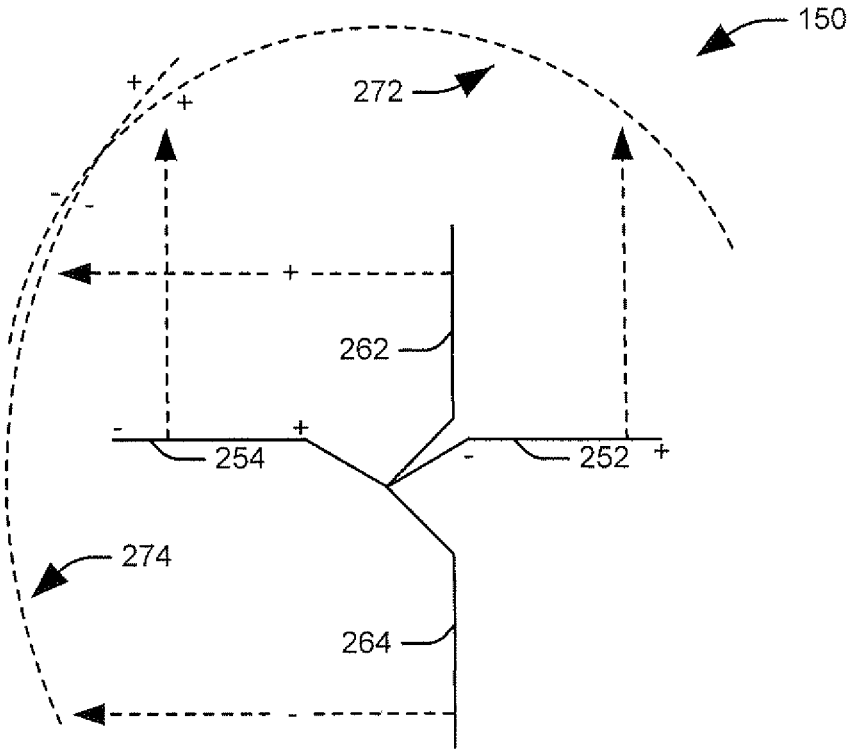
FIG. 6B illustrates a cross sectional view of an antenna system at a second time illustrating the constructive interference of the generated signals in space.

FIGS. 6A and 6B illustrate a cross sectional view of an antenna system 250 similar to that illustrated in FIG. 3 at two different times to illustrate the constructive interference of the generated signals in space. As has been explained previously, the antenna system 250 comprises a plurality of elements arranged to provide circular polarization within each of three orthogonal planes with the same handedness (e.g., right handed from the perspective of the source). As illustrated in FIGS. 6A and 6B, however, the antenna assembly is further configured such that the polarity, or phasing, of signals from each element is the same at the point at which they merge, such that for a given pair of elements, the phasing is the same along a line of merger (e.g., along a forty-five degree angle between the elements) with a plane defined by the pair of elements. In other words, there is little to no cancellation of the signal of signals at forty-five degrees off-axis, but instead a constructive interference between in phase signals.

FIG. 6A illustrates the antenna assembly 250 at a first instant in time. A first element 252 and a second element 254 are each aligned along a first axis and providing a signal having a same polarity along the first axis, resulting in a first combined signal 256. A third element 262 and a fourth element 264 are each aligned along a second axis and providing a signal having a same polarity along the second axis, resulting in a second combined signal 266. At an intersection point of the first and second combined signals 256 and 266, it will be appreciated that the combined signals aligned as to be in phase, such that the signals constructively interfere.

FIG. 6B illustrates the antenna assembly at a second instant in time, which is half of a period of the characteristic frequency of the antenna after the first instance in time. In FIG. 6B, the polarity of each of the first, second, third, and fourth elements 252, 254, 262, and 264 is reversed, producing a third combined signal 272 and a fourth combined signal 274. Much like the signal interaction a half period previous, at an intersection point of the third and fourth combined signals, it will be appreciated that the combined signals 272 and 274 are aligned as to be in phase, such that the signals constructively interfere. It will be appreciated that the antenna assembly is configured such that a similar interaction would be seen regardless of the choice of plane, providing a substantially isotropic radiation pattern from a single feed point.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

Having described the invention, I claim:

1. An antenna assembly having a characteristic frequency band, comprising:

an antenna feed, operatively connected to one of a radio frequency (RF) transmitter, an RF receiver, and an RF transceiver system;

a ground component;

a first set of conductive elements, comprising at least one of linear, bent linear, and curvilinear elements, and operatively connected to the antenna feed; and a second set of conductive elements, comprising at least one of linear, bent linear, and curvilinear elements, operatively connected to the ground component;

wherein each element of the first set of conductive elements is aligned in a direction substantially perpendicular to a corresponding element of the second set of conductive elements, such that the first set of conductive elements and the second set of conductive elements are configured as to provide substantially equal sensitivity within the characteristic frequency band across all elevation and azimuth angles.

2. The antenna assembly of claim 1, the first set of conductive elements and the second set of conductive elements being further configured to provide a substantially circularly polarized response within each of three mutually orthogonal planes.

3. The antenna assembly of claim 2, the substantially circular polarized response within each of the three mutually orthogonal planes having a common handedness.

4. The antenna assembly of claim 1, each of the first set of conductive elements having a length substantially equal to one-quarter of the characteristic wavelength.

5. The antenna assembly of claim 1, each of the first set of conductive elements having a length substantially equal to three-quarters of the characteristic wavelength.

6. The antenna assembly of claim 5, each of the first set of conductive elements being continuous and comprising a first linear segment, having a length substantially equal to one-quarter of the characteristic wavelength and a second linear segment having a length substantially equal to one-half the characteristic wavelength, the first segment forming a one hundred thirty-five degree angle with the second segment.

7. The antenna assembly of claim 5, each of the first set of conductive elements being continuous and comprising a first linear segment, having a length substantially equal to one-quarter of the characteristic wavelength and a second linear segment having a length substantially equal to one-half the characteristic wavelength, the first segment forming a ninety degree angle with the second segment.

8. The antenna assembly of claim 1, the first set of conductive elements comprising a first linear element, aligned along a first axis, and a second linear element, aligned along the first axis, and the second set of conductive elements comprising a third linear element, aligned along a second axis, and a fourth linear element, aligned along the second axis, each of the first, second, third, and fourth linear elements having a length substantially equal to one-half of the characteristic wavelength.

9. An antenna assembly comprising:

a first active element connected to an antenna feed at an apex point and extending in a first direction;

a first counterpoise element connected to a ground element associated with the antenna feed and extending in a second direction substantially perpendicular to the first direction;

a second active element connected to the antenna feed at the apex point and extending in a third direction; and a second counterpoise element, connected to the ground element and extending in a fourth direction substantially perpendicular to the third direction.

10. The antenna assembly of claim 9, further comprising:

a third active element connected to the antenna feed at the apex point and extending in a fifth direction substantially perpendicular to each of the first direction and the third direction; and a third counterpoise element, connected to the ground element and extending in a sixth direction substantially perpendicular to each of the second direction and the fourth direction.

11. The antenna assembly of claim 10, the first active element and the first counterpoise element being configured to provide a first bent half-wave dipole having a first orientation, the second active element and the second counterpoise element being configured to provide a second bent half-wave dipole having a second orientation orthogonal to the first orientation, and the third active element and the third counterpoise element being configured to provide a third bent half-wave dipole having a third orientation orthogonal to each of the first orientation and the second orientation.

12. The antenna assembly of claim 9, each of the first active element, the second active element, the first counterpoise element, and the second counterpoise element being linear and having a length substantially equal to one-quarter of a characteristic frequency of the antenna assembly.

13. The antenna assembly of claim 9, the antenna assembly being tuned to an operating frequency of 2.4 gigahertz, such that a characteristic wavelength of the antenna is approximately 12.5 centimeters.

14. An antenna assembly configured to provide a substantially isotropic response at a characteristic wavelength of the antenna assembly comprising:

a first active element operatively connected to an antenna feed and oriented along a first axis, the first active element being one of linear, bent linear, and curvilinear and having a length substantially equal to one-half of the characteristic wavelength;

a first counterpoise element operatively connected to a ground element and oriented along the first axis, the first counterpoise element being one of linear, bent linear, and curvilinear and having a length substantially equal to one-half of the characteristic wavelength;

a second active element operatively connected to the antenna feed and oriented along a second axis that is perpendicular to the first axis, the second active element being one of linear, bent linear, and curvilinear and having a length substantially equal to one-half of the characteristic wavelength; and a second counterpoise element operatively connected to the ground element and oriented along the second axis, the second counterpoise element being one of linear, bent linear, and curvilinear and having a length substantially equal to one-half of the characteristic wavelength.

15. The antenna assembly of claim 14, further comprising:

a third active element operatively connected to the antenna feed and oriented along a third axis that is perpendicular to each of the first axis and the second axis, the third active element being one of linear, bent linear, and curvilinear and having a length substantially equal to one-half of the characteristic wavelength; and a third counterpoise element operatively connected to the ground element and oriented along the third axis, the third counterpoise element being one of linear, bent linear, and curvilinear and having a length substantially equal to one-half of the characteristic wavelength.

16. The antenna assembly of claim 14, wherein, along a third direction perpendicular to each of the first active element and the second counterpoise element, the first active element and the second counterpoise element are separated by a distance substantially equal to one-quarter of the characteristic wavelength.

17. The antenna assembly of claim 14, each of the first active element and the second active element being connected to the antenna feed via respective first and second linear conductive elements each having a length substantially equal to one-quarter of the characteristic wavelength.

18. The antenna assembly of claim 17, each of the first counterpoise element and the second counterpoise element being connected to the ground element via respective third and fourth linear conductive elements, the first linear conductive element having a orientation substantially parallel to an orientation of the third linear conductive element.

19. A wireless router comprising the antenna assembly of claim 14.

* * * * *